United States Patent [19]

Price

[11] 4,268,218

[45] May 19, 1981

[54] PREVENTING THE OVERCHARGING OF COKE OVENS

[75] Inventor: Charles A. Price, Portage, Ind.

[73] Assignee: United States Steel Corporation, Pittsburgh, Pa.

[21] Appl. No.: 13,953

[22] Filed: Feb. 22, 1979

[51] Int. Cl.[3] ..... C10B 31/04; G01F 23/14

[52] U.S. Cl. ..... 414/786; 73/290 R; 414/161

[58] Field of Search ..... 414/148, 161, 289, 294, 414/296, 786; 202/262, 263; 73/290 R, 298

[56] References Cited

U.S. PATENT DOCUMENTS

| | | | |
|---|---|---|---|
| 3,707,237 | 12/1972 | Wiemer | 202/262 X |
| 4,017,269 | 4/1977 | Dutz et al. | 414/161 X |
| 4,058,230 | 11/1977 | Bellenberg et al. | 414/161 X |

*Primary Examiner*—Robert G. Sheridan

*Attorney, Agent, or Firm*—Arthur J. Greif

[57] ABSTRACT

A method for preventing the overcharging of coal into a coke oven system in which preheated coal is transported from a storage container to the coke ovens by means of a substantially enclosed continuous conveyor system filled with inert gas. A portion of inert gas within the enclosed conveyor system is carried along with the coal into the coke oven itself. During filling of the oven, this inert gas is carried up and out of the oven standpipes. When the oven becomes filled, however, the standpipe escape route becomes blocked resulting in a rapid pressure build-up within the system. This rapid pressure build-up is utilized to generate a signal to stop further filling of the oven. The instant method may be employed as a primary regulating system, but is more preferably employed as a back-up to conventional sensor probes used for regulating the level of coal.

6 Claims, 3 Drawing Figures

PREVENTING THE OVERCHARGING OF COKE OVENS

A comparatively recent development for the charging of coal into a coke oven is that in which preheated coal is transported from a storage bunker or container to the ovens by means of a substantially enclosed continuous conveyor system. The basic operations of such systems is described, for example, in U.S. Pat. No. 3,707,237, the disclosure of which is incorporated herein by reference. Such systems generally comprise four basic elements: (1) a metering device, connected to or incorporated within the coal storage container, for measuring an amount of coal corresponding approximately to the volume of the oven to be charged; (2) an enclosed, continuous conveying means, generally in the form of a chain conveyor, for transporting the measured amount of a coal to its associated coke oven; (3) a coke oven battery, comprising an array of coke ovens each having one or more charging holes for receiving the measured amount of coal and (4) a vertical conduit for connecting an opening in the conveyor system (controlled, for example, by a slide-gate) with a respective coke-oven charging hole. Generally associated with the conduit, is a sensor probe for regulating the level of coal in the oven. Such sensor probes may take the form of mechanical float means or more generally, a pressure sensing tube for measurement of the level of coal within the oven (see, for example, U.S. Pat. No. 4,058,230). When the coal reaches the proper level in the oven, the probe is designed to open an electrical circuit thus stopping the further charging of coal into the oven. However, either as a result of human failure or malfunction of the probe, such systems have, in some instances, failed to prevent overfilling of the oven, resulting in loss of coal and damage to related systems, but also creating a fire hazard and its concommitant dangers to human life. The need for a fail-safe system is clearly evident. The instant invention, due to its simplicity, is less prone to malfunction and can either be used as a primary level regulating system or as a back-up system in conjunction with conventional, more sensitive, level-sensing probes.

The use of the instant invention and the advantages thereof will better be understood by reference to the following description when read in conjunction with the appended claims and the drawing in which:

Figure 1:
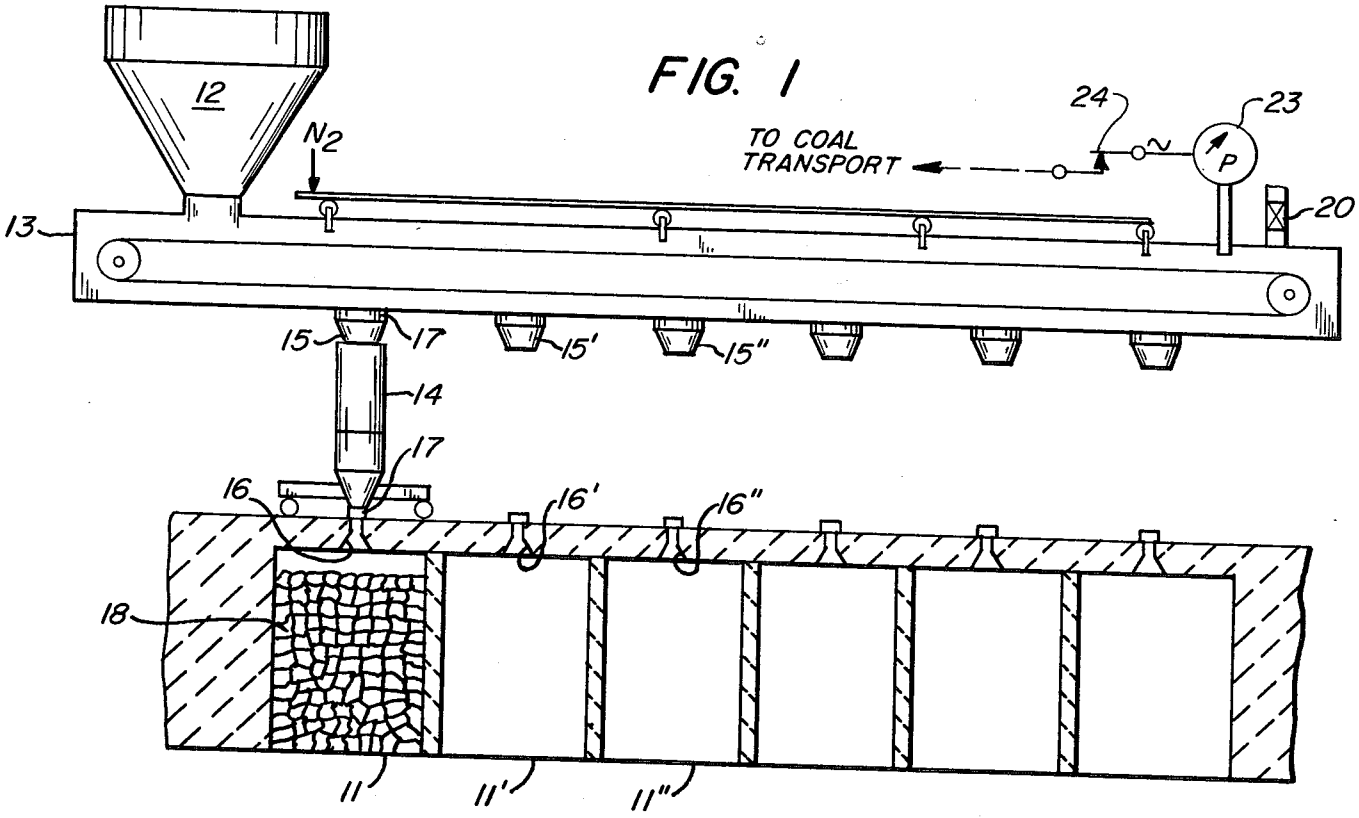
FIG. 1 is a longitudinal section of a coke-oven battery, showing a coal storage container connected to an enclosed conveying system and conduits for supplying coal to charging holes in the coke-oven chambers.
Figure 2:
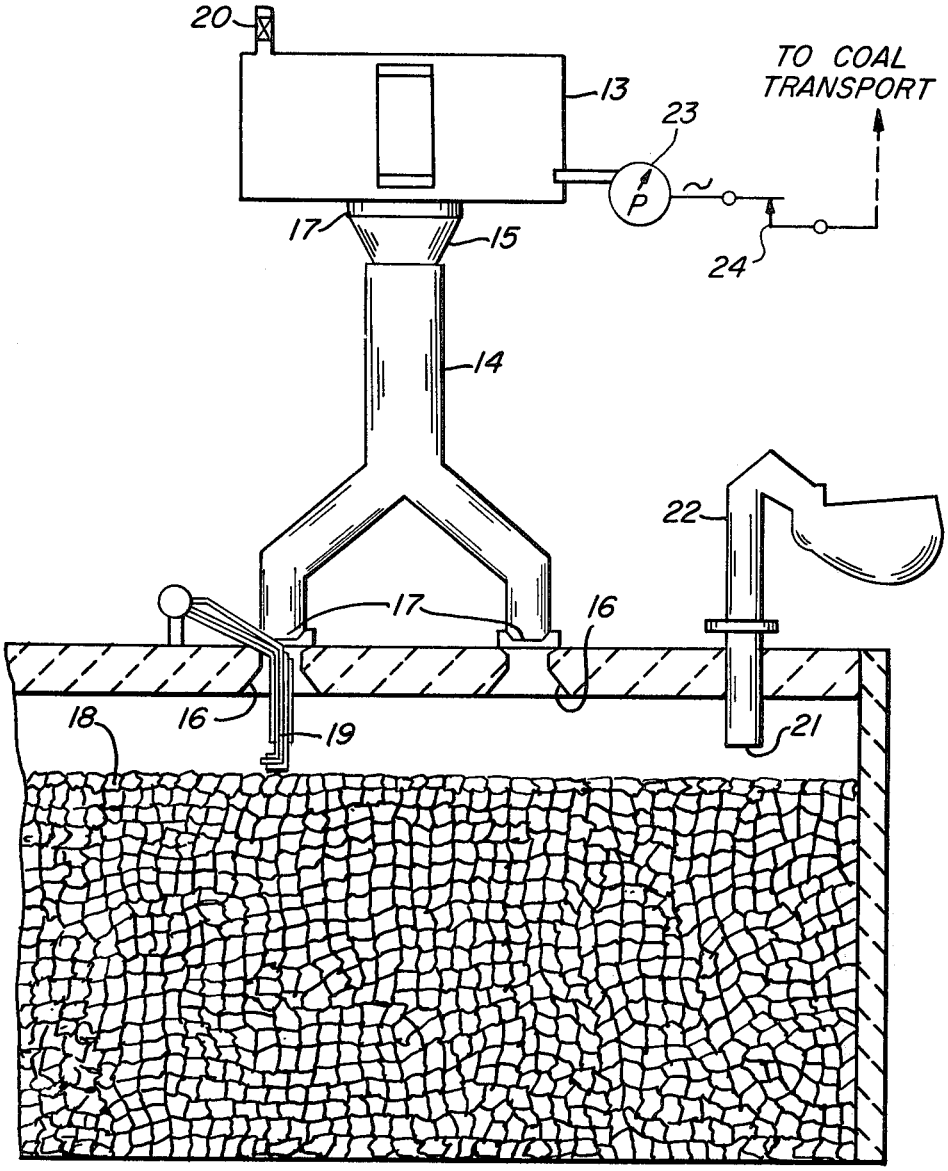
FIG. 2 is an enlarged, transverse cross-section of the coke-oven battery of FIG. 1.
Figure 3:
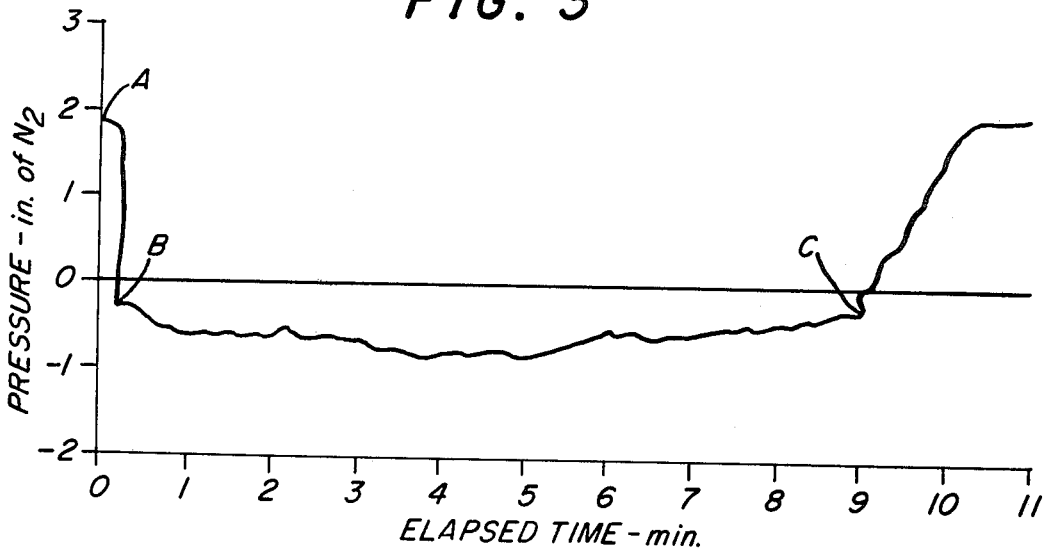
FIG. 3 is a graph depicting the variation of pressure immediately prior to and during the filling of a coke oven.

Referring to FIGS. 1 and 2, in the use of preheated coal for the charging of coke ovens 11, 11', 11'', the coal must necessarily be transported from the storage bunker 12 to the coke oven by means of a hermetically-sealed conveyor system 13 to prevent oxidation of the hot coal. When an oven is designated for charging, a vertical conduit 14 for connecting an opening 15 in the conveyor system with a respective coke oven charging hole 16, is located over the designated oven's charging holes and slide gates 17 are then opened to make that oven ready to receive coal. A predetermined amount of coal is then transported from the storage area via the hermetically-sealed conveyors to that oven's charging holes. After but a few minutes, when the coal 18 reaches the proper level in the oven, generally determined by a level-measuring device 19, an electrical circuit is opened, either manually or automatically, so as to stop the transportation of additional coal. On occasion, as a result of error or malfunction, conditions have arisen in which coal continues to fall from the conveyor system, overfilling the oven and damping related equipment. This has, in fact, happened in actual practice as a result of (i) human error, i.e. failure of the operator to insert the level measuring device into the oven, (ii) the failure of the gaseous supply system, whether air or inert gas, to the level-measuring probes and (iii) malfunction of the probe system itself. On at least one occasion, failure to prevent overfilling of hot coal resulted in a major fire costing hundreds of thousands of dollars in damage. As a result of the possibility of probe malfunction, it has been suggested that two probes be utilized, one as the backup for the other. The use of such a double-probe system is a partial solution. However, it will not overcome the problem of human error. Equally important, such a double system is quite costly, since it not only requires the purchase of twice as many probes, but also requires twice the amount of auxiliary systems, e.g. gas supply sources. As a result, the instant invention was initially developed as a low-cost alternative back-up system. It will be evident, however, that the method described herein is equally applicable in its use as a primary system for level determination. As noted, nitrogen or other nondeleterious gas is introduced into a substantially enclosed (expect for offtake valve, noted below) conveyor system for the purpose of reducing the oxygen content therein to prevent undue oxidation of preheated coal. As with most pressurized systems, the coal conveying enclosures are normally fitted with offtake valves for maintaining proper and safe pressures within the system. Thus, when coal is not being charged from the conveyor to the oven, there exists a continual exit of gas through the relief valve 20. I have discovered, however, during the actual charging of coal, that the major portion of the gas rather than escaping through the system's relief valve, is instead carried along with the coal flowing into the oven, thereafter escaping through the oven standpipes 22. Referring to FIG. 3, it is seen that upon opening of the slide gate (point "A"), controlling flow into the oven, that the actual charging of coal is associated with a significant pressure drop ("B") within the substantially enclosed system. During charging of the coal some variation in pressure is noted, but the amplitude of such variation is small compared with that resulting from the initiation of charging. If the lower extremity 21 of the standpipe 22 were to become blocked by the filling of the oven, the gas, which is being carried along with such charged coal, will no longer have the relatively large escape route into the standpipe. Thus, even though the gas may still escape through the relief valve 20, its major escape route, i.e. the standpipes, will no longer be available -- resulting in a significant pressure increase "C" within the enclosed system. By determining when such substantial pressure increase has occurred, and generating a signal in response to that increase, the system can then be shut-down preventing overfilling of the oven.

The actual determination of such a substantial increase can be effected in a variety of ways. For example, a timing device could be employed to energize a pressure sensor 23 during the latter portion of the normal charging period, which sensor would be designed to trip an electrical circuit 24 at a predetermined gauge pressure, higher than the maximum gauge pressure encountered during normal filling of the oven. Rather than utilizing a specific gauge pressure as an indication of an alarm condition; increases in the absolute value of pressure, or rates of increase in pressure over a predetermined minimum time period could similarly be utilized as the determinant factor. It will also be evident that pressure need not be determined directly, and other variables which fluctuate as a function of pressure will likewise provide a reliable indication of an alarm condition. Thus, the flow rate of the protective gas may serve as such an indicator. For example, a flowmeter would be incorporated into the nitrogen regulator supply line, so as to effect shut-down on an abnormal decrease, either in the volume of nitrogen flow or below a preset value of such flow. Such an abnormal decrease in flow would be encountered as a result of the nitrogen regulator's system slowing down the amount of gas supplied in response to an increase in pressure within the enclosure.

I claim:

1. In the charging of coke ovens with coal from a coal storage container, wherein the coal is transported from the container by a conveyor system overlying a coal inlet, said inlet communicating with an opening in the roof of the coke oven; said storage container, said conveyor, said inlet and said oven being interconnected to form a substantially enclosed system pressurized with a non-deleterious gas, said coke oven having a standpipe for the removal of coal coking gases, the lower extremity of said standpipe being located in the upper portion of the oven, the improvement for preventing the overcharging of said oven which comprises, during at least the latter portion of the charging period monitoring a variable which is a function of the pressure in said enclosed system, determining when said variable shows an increase substantially greater than the normal variation thereof encountered during charging, generating a signal in response to such substantial variable increase and stopping the charging of coke in response to said signal.

2. The method of claim 1, wherein said variable is pressure.

3. The method of claim 1, wherein the lower extremity of said standpipe is located approximately at the desired level of a full oven.

4. The method of claim 3, including the employment of a sensor probe for stopping the feed of coal into said oven, wherein the lower extremity of said standpipe is located at a level no longer than the lower extremity of said sensor probe.

5. The method of claim 4, wherein said variable is pressure.

6. The method of claim 5, wherein said sensor probe is a pressure sensing tube.

* * * * *